US005699324A

United States Patent [19]

Perrot et al.

[11] Patent Number: 5,699,324

[45] Date of Patent: Dec. 16, 1997

[54] DEVICE FOR SECURING A WATCH DIAL

[75] Inventors: Friedrich Perrot, Lengnau; Marco Bettelini, Biel, both of Switzerland

[73] Assignee: Eta SA Fabriques d'Ebauches, Grenchen, Switzerland

[21] Appl. No.: 632,360

[22] Filed: Apr. 10, 1996

[30] Foreign Application Priority Data

Apr. 25, 1995 [CH] Switzerland ..... 01174/95

[51] Int. Cl.[6] ..... G04B 19/32; G04B 19/06; G04B 37/00

[52] U.S. Cl. ..... 368/226; 368/236; 368/294

[58] Field of Search ..... 368/223, 226, 368/227, 228, 232, 236, 237, 67, 294–296

[56] References Cited

U.S. PATENT DOCUMENTS

| | | | |
|---|---|---|---|
| 1,074,130 | 9/1913 | Miller | 368/236 |
| 4,150,538 | 4/1979 | Nakayama et al. | 58/88 R |
| 4,183,204 | 1/1980 | Sauter | 368/236 |
| 4,213,295 | 7/1980 | Perrot | 368/236 |
| 5,265,071 | 11/1993 | Thorgersen et al. | 368/67 |
| 5,430,694 | 7/1995 | Perrot | 368/88 |

FOREIGN PATENT DOCUMENTS

| | | |
|---|---|---|
| 1 447 578 | 11/1966 | France . |
| 2 077 399 | 10/1971 | France . |
| 30614 | 5/1904 | Switzerland . |
| 77267 | 4/1918 | Switzerland . |
| 225 819 | 2/1943 | Switzerland . |
| 353 310 | 3/1961 | Switzerland . |
| 645 497 | 10/1984 | Switzerland . |

*Primary Examiner*—Vit W. Miska

*Attorney, Agent, or Firm*—Griffin, Butler, Whisenhunt & Kurtossy

[57] ABSTRACT

A retaining ring (17) which rests on the peripheral area of the dial (16), which is in turn bonded to a dial support (14). Several securing means (25) are on the one hand secured in the retaining ring (17) and on the other hand in a base element (13), such as an annular tool holder. This ensures a flat, smooth and lasting support of the dial (16) on the dial support (14). It also permits the simple assembly and dismantling of the unit composed of dial (16), dial support (14) and annular securing means (17) onto or from a base element (13).

19 Claims, 4 Drawing Sheets

DEVICE FOR SECURING A WATCH DIAL

BACKGROUND OF THE INVENTION

Figure 1:
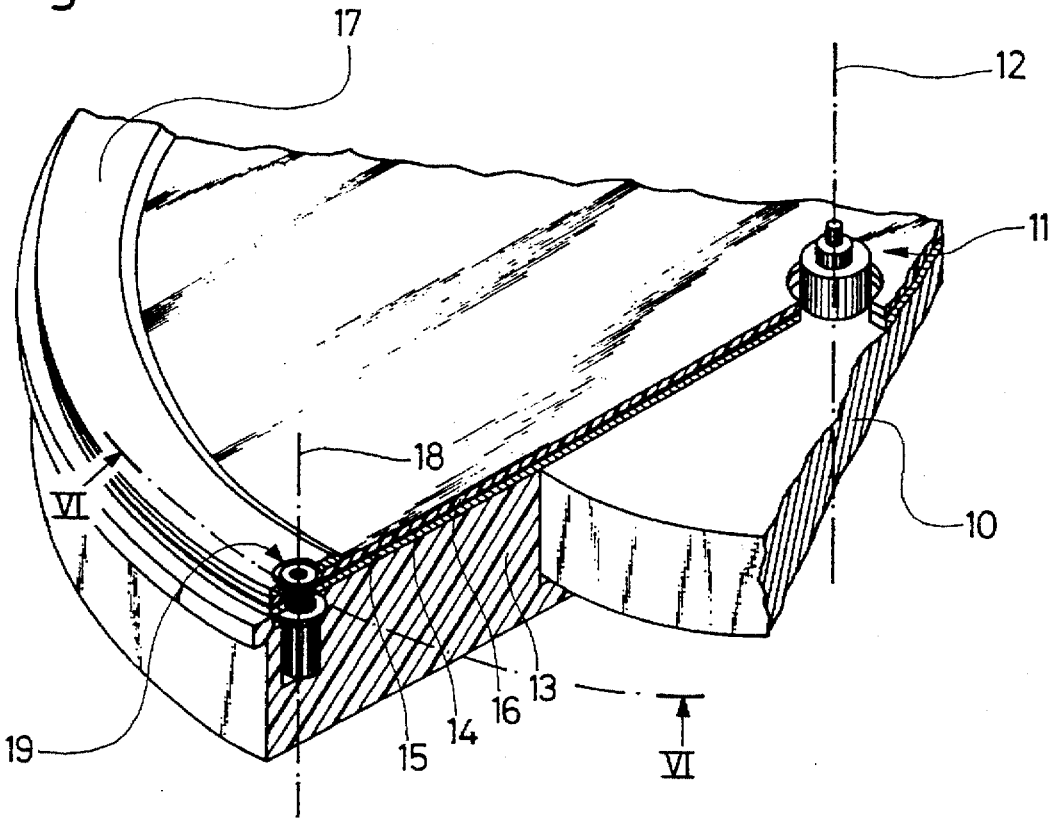

The invention relates to a device for securing a watch dial according to the classifying portion of claim 1.

In particular, the device of the invention is intended for timepieces with electroluminescent dials.

Electroluminescent dials fundamentally have two electrodes and an electroluminescent layer interspersed therebetween. The electrode disposed on the upper side is transparent. The electroluminescent layer is caused to light up by a current applied to the electrodes. The lighting effect is visible to the wearer of the watch through the transparent electrode.

U.S. Pat. No. 5,265,071discloses a watch with a dial of this kind. According to this document, the dial is stuck onto the dial of a dial support which, in turn, is inserted onto the movement. The peripheral area of the dial support has a recess through which a zebra contact projecting from the movement protrudes and which exerts pressure on the underlying electrode of the dial because of its foam-like properties. A bracket attached to the dial, curved around the movement and screwed to the underside thereof permits contact with the superimposed electrode.

Since the zebra contact projecting from the movement exerts constant pressure on the dial, the dial inevitably becomes detached from the dial support during storage of the movement, and bumps are formed. This effect occurs basically regardless of the nature of the adhesive since the force exerted by the contact is not distributed, but acts locally at one point of the dial. The solution proposed in U.S. Pat. No. 5,265,071is therefore unable to ensure a satisfactory permanent connection between dial and dial support.

Although this solution basically permits a repeated assembly and dismantling of the unit composed of the dial and the dial support onto and from a basic element, such as the base plate complicated manoeuvres have to be carried out for this purpose. In particular, the assembly process involves bending the bracket, introducing and tightening the screw, which requires a great deal of time and therefore has a deleterious effect on manufacturing costs.

It is therefore an object of the invention to provide a device which ensures a flat, even and lasting support of the dial on the dial support and simple assembly and dismantling of the unit composed of the dial and its support onto and from a basic element, such as a base plate or an annular tool holder.

SUMMARY

The solution to this object according to the invention is set out in the features of claim 1.

The device of the invention has the following advantages compared to the state of the art:

Since the solution according to the invention provides an annular securing means which presses the peripheral area of the dial onto the dial support it permits a flat, even and lasting support of the dial on the dial support. It also permits the simple assembly and dismantling of the unit composed of the dial, the dial support and the annular securing means onto or from a basic element, such as a base plate or an annular tool holder.

According to a preferred embodiment of the device of the invention, rivet-shaped securing pins are provided passing through the dial, the dial support and the annular securing means which ensure a firm retention.

According to a preferred embodiment of the invention, the securing pins are welded to the annular securing means. This makes it possible, not only to assemble the unit on the base element, but also to place the dial support, the dial and then the annular securing means in succession directly onto the base element.

A BRIEF DESCRIPTION OF THE DRAWINGS

Figure 2:
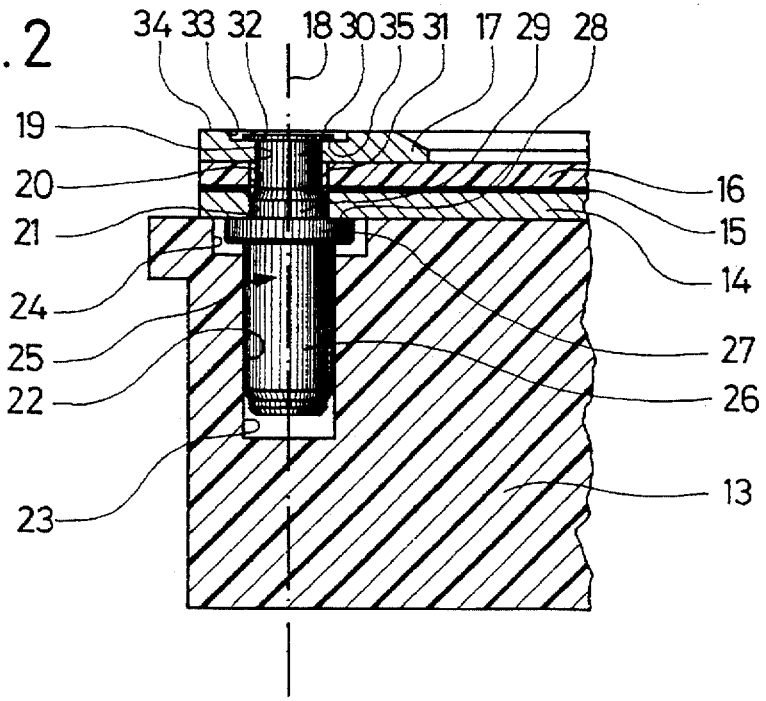

The invention is explained hereafter in various embodiments, reference being made to the drawings. There are shown in:

FIG. 1 a partial section of the device of the invention in a first embodiment in spatial, enlarged, schematic representation, FIG. 2 a vertical section according to FIG. 1.

Figure 3:
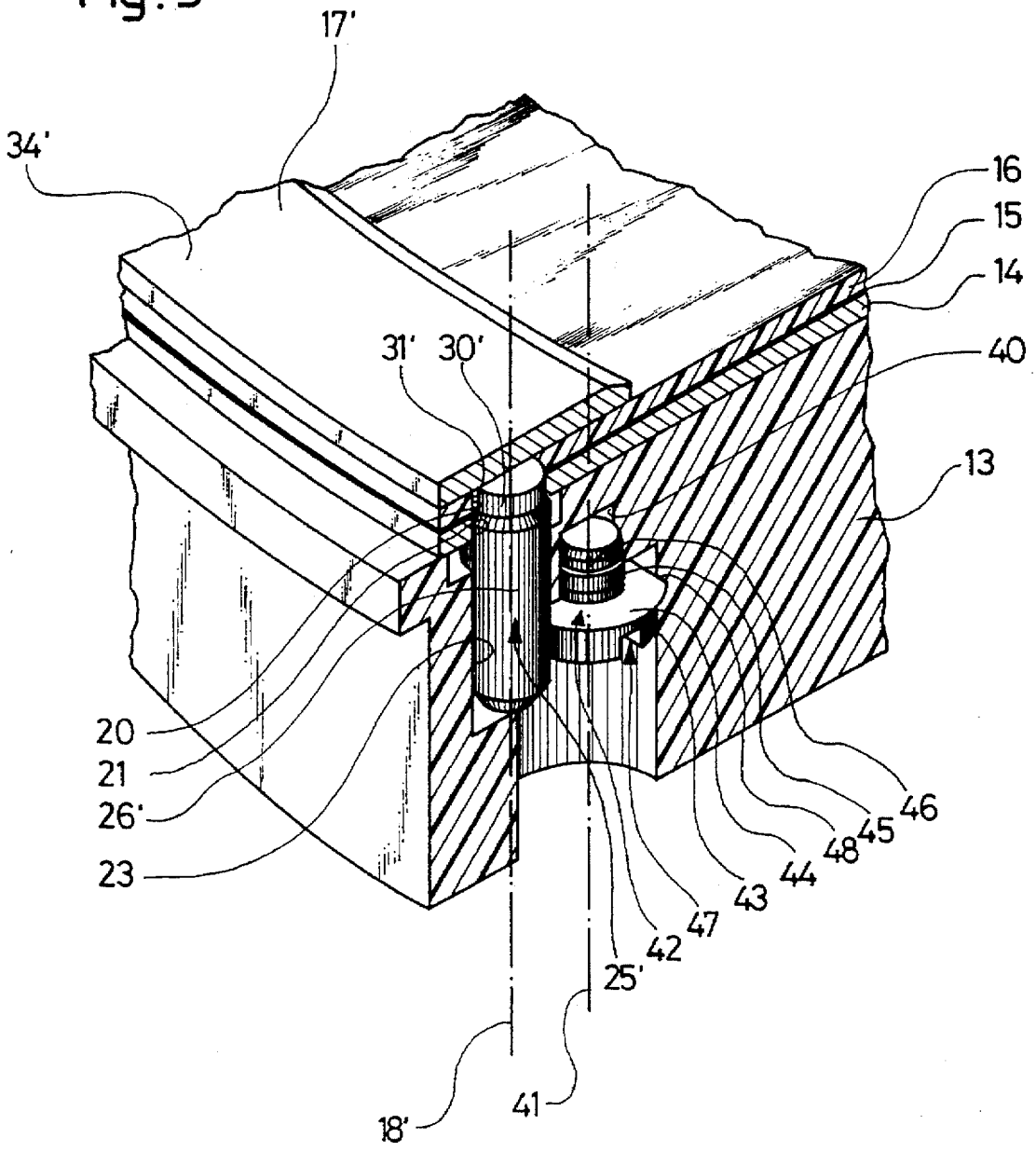
Figure 4:
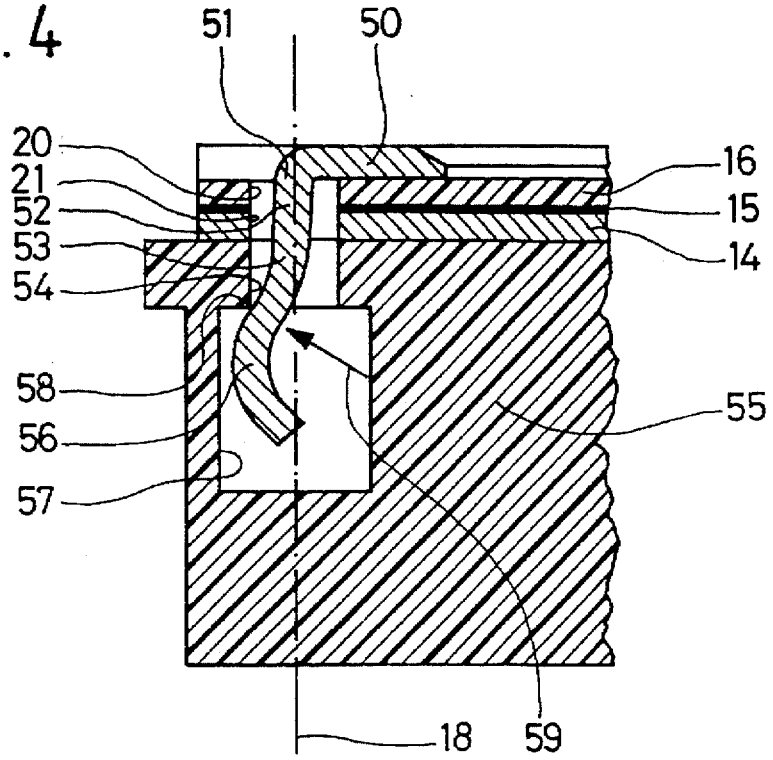
Figure 5:
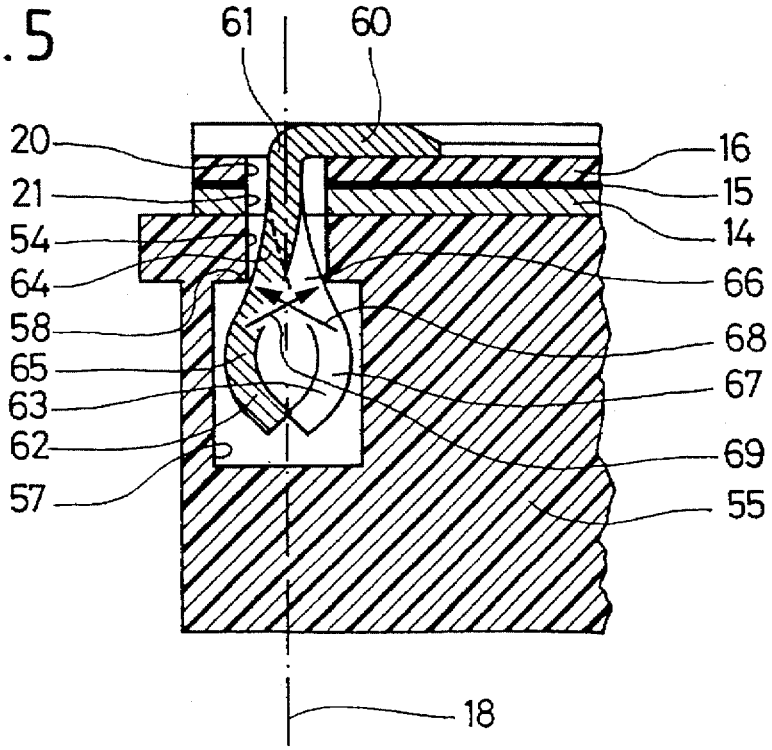
Figure 6:
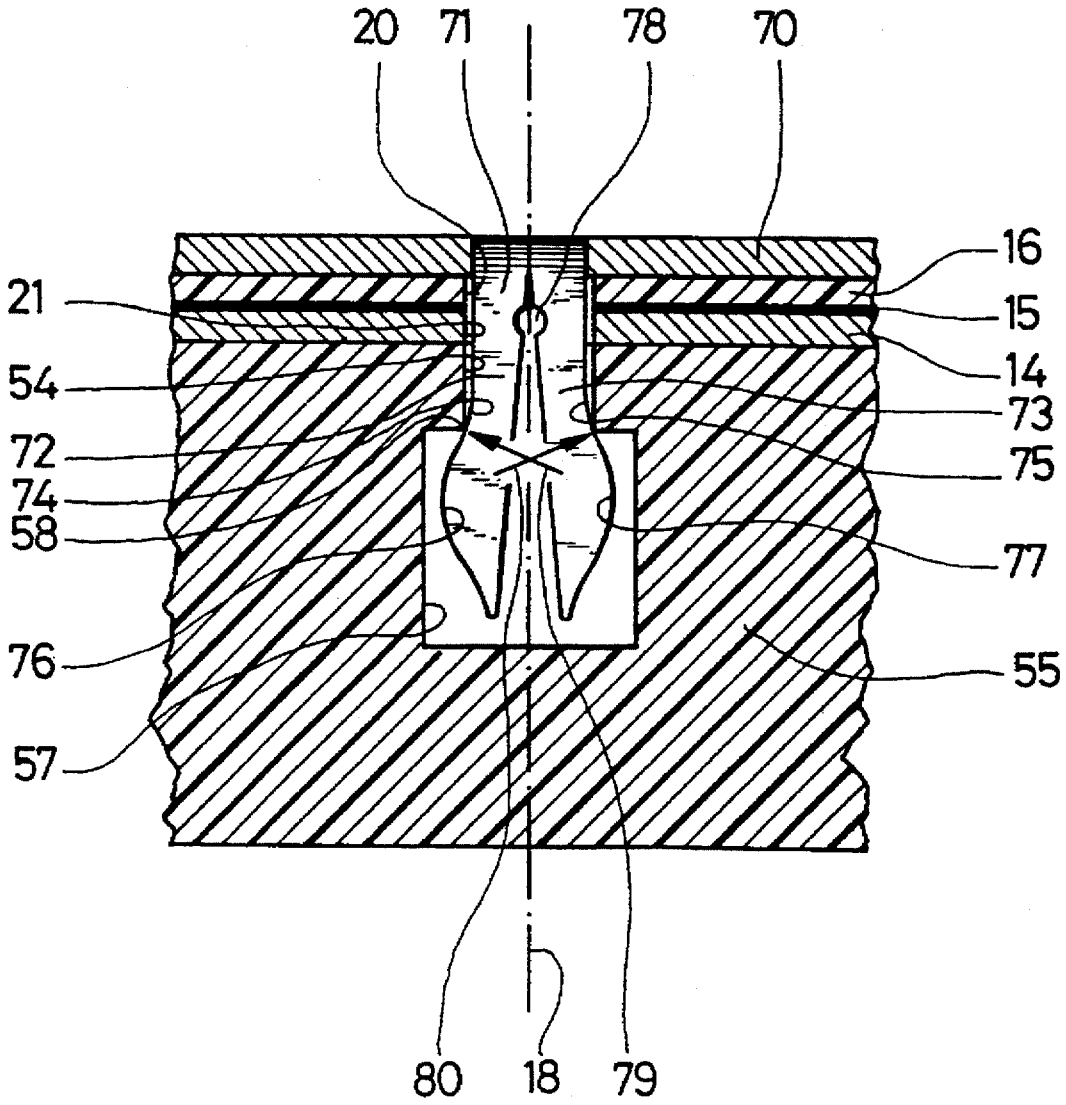

FIG. 3 a partial section of the device according to the invention in a second embodiment in spatial, enlarged, schematic representation, FIG. 4 a vertical section of the device of the invention in a third embodiment in spatial, enlarged, schematic representation in the same view as FIG. 2, FIG. 5 a vertical section of the device of the invention in a fourth embodiment in spatial, enlarged, schematic representation in the same view as FIG. 2, FIG. 6 vertical section of the device of the invention in a fifth embodiment in spatial, enlarged, schematic representation according to the section VI—VI of FIG. 1.

A DESCRIPTION OF THE PREFERRED EMBODIMENTS

FIG. 1 shows a movement 10 diagrammatically in a diagonal plan view. A group of drive elements 11 composed of a drive axle and two drive tubes projects from the movement 10. Hour, minute and second hands (not shown) are mounted thereon in conventional manner. An axis of rotation designated 12 passes through the group of drive elements 11. The movement 10 is inserted in conventional manner into an annular tool holder 13 advantageously consisting of a plastic. This annular tool holder 13, also termed enlargement collar, is in turn secured to the timepiece housing or central portion (not shown).

Lying on the upper side of the annular tool holder 13 and of the movement 10 is a round dial support 14 of, for example, brass, that totally covers this side of the annular tool holder 13 and the movement 10. An electrically insulating adhesive layer 15 is applied to the dial support 14 which secures a conventional electroluminescent dial 16 onto the dial support 14. The already known composition of the dial 16, consisting substantially of two electrodes and an interposed electroluminescent layer, is not shown.

The electrical energy needed to light up the dial can be applied in a conventional manner, for example via two spring contacts projecting from the peripheral area of the annular tool holder 13. The underside of the lower electrode is admitted through one of the springs whereas the other spring presses through a recess passing through the lower electrode and the electroluminescent layer onto the underside of the upper transparent electrode. The springs have not been shown here in the interests of clarity.

A conventional supply circuit (not shown) is provided in the annular tool holder 13 which transforms the direct current supplied by the battery (also not shown) so as to permit the appropriate illumination of the electroluminescent dial 16. This makes it possible to switch on the dial 16 using a push button not shown herein, designed as a quick-action switch.

A flat annular brass securing means hereinafter referred to as the lower retaining ring 17 is disposed on the dial 16 in the area of its periphery having a hole 19 passing therethrough is formed in the direction of an axis 18 according to FIG. 1, which runs parallel to the axis of rotation 12. Hereinafter the description relates to the description of the area of the axis 18 shown in FIG. 1 which emerges more clearly from the detailed section of FIG. 2.

Further holes, 20 and 21 respectively, are provided underneath the hole 19 through the dial 16 as well as the dial support 14. Also provided in the line of the axis 18 in the annular tool holder 13 is a step-shaped blind hole 22 having a lower, more elongated hole area 23 and an upper, shorter hole area 24 of somewhat larger diameter. Located inside the four holes 19 to 22 is a rotating-symmetrical securing pin 25, made for example of brass. In addition, other securing pins 25 (not shown in FIG. 1 and 2) and the section of FIG. 2 also applies to them and to their surroundings. A total of two opposing securing pins 25, or three disposed in an angle distance of 120°, are advantageously provided.

The representative securing pin 25 shown in FIG. 2 has a longer cylindrical shaft 26 which sits securely in the hole area 23 of the blind hole 22. Associated with the top of this shaft 26 is a thin annular flange 27 which is located in the short hole area 24. The flange 27 has on its upper side an annular support surface 28 which is flush with the upper side of the annular tool holder 13. The dial support 14 thus lies on the support surface 28 of the flange 27. In connection with the flange 27 the securing pin 25 has a short area 29 which is located in the through hole 21 of the dial support 14. The securing pin 25 narrows in the area of the adhesive layer 15, i.e. the short area 29 develops into a longer area 30 having a smaller diameter. This area 30 does not completely fill the hole 20 of the dial 16, but leaves a substantially hollow cylindrically-shaped free space 31 which ensures the electrical insulation between the dial 16 and the securing pin 25. The area 30 of the securing pin 25 also passes through the through hole 19 of the retaining ring 17 and opens into a rivet head 32, shown flattened, which is located in a widened area 33 of the through hole 19, so that the rivet head 32 is recessed into the retaining ring 17 and the latter still has a smooth surface 34. On its underside the rivet head 32 has a support surface 35 which rests on the retaining ring 17, In the embodiment shown in FIGS. 1 and 2, dial support 14, dial 16 and retaining ring 17 are first riveted by means of the securing pins 25 into a compact unit hereinafter termed the dial unit. This dial unit can be stored for a time or immediately thereafter inserted as a whole onto the movement 10 or the annular tool holder 17, the shafts 26 of the securing pins 25 being secured in the blind holes 22 of the annular tool holder 13. Two to three securing pins 25 suffice for the sufficiently secure anchoring of the retaining ring 17 in the annular tool holder 13. An appropriate number of holes 19 to 22 are of course provided.

Since the dial support 14, the retaining ring 17 and the securing pins 25 of this embodiment are made of brass, the electrically insulating 15 and the hollow cylindrically-shaped free space 31 prevent any short circuit between the two electrodes of the dial 16. As already stated, the electrical energy needed to illuminate the dial is supplied by two spring contacts projecting from the annular tool holder 13.

FIG. 3 shows a different embodiment of the retaining ring 17 shown in FIGS. 1 and 2. Welded to the underside of retaining ring 17' are several, advantageously two to three, securing pins 25', as known in conventional dials and their dial feet, with the result that retaining ring 17' has an even surface 34'. FIG. 3 only shows one single representative securing pin 25' of rotation-symmetrical shape in relation to an axis 18' corresponding to the axis 18 shown in FIGS. 1 and 2 and has a cylindrical shaft 26' that is largely located in the longer hole area 23 of the annular tool holder 13. The securing pin 25' becomes thinner in the area of the adhesive layer 15, i.e. the shaft 26' changes into a cylindrical area 30' of smaller diameter. The area 30' does not completely fill the hole 20 of the dial 16, but leaves a hollow-cylindrically shaped free space 31', as in the embodiment of FIGS. 1 and 2, which ensures the electrical insulation between the dial 16 and the securing pin 25'. A conventional rotatable dial bolt 42, located immediately adjacent second pin 25' is inserted into an additional bore 40 provided in the annular tool holder 13, the axis 41 of which runs at least substantially parallel to the axis 18'. The dial bolt 42 has a head 43 which is partially surrounded by a cutting edge 44 disposed concentrically to the axis 41, as well as a first cylindrical part 45 and a second cylindrical part 46 somewhat smaller in diameter. The diameter of the first cylindrical part 45 permits a secure fit of the dial bolt 42 inserted into the bore 40. The head also has a slit 47 on which a screwdriver-like tool (not shown) can be fitted. Part of the head 43 and the cutting edge 44 is severed along a parallel cutting level, advantageously parallel to the axis 41, forming a cutting surface 48. This cutting surface 48 is shown in FIG. 3 on the side facing away from the securing pin 25'. In this rotational location of the dial bolt 42 the cutting edge 44 penetrates the securing pin 25', anchoring this in the direction of the axis 18'. Anchoring of this kind is provided for each securing pin 25'.

By analogy to the embodiment shown in FIGS. 1 and 2, the dial unit shown in FIG. 3 composed of dial support 14, dial 16 and retaining ring 17' can also be pre-assembled and optionally intermediately stored. However, in the embodiment shown in FIG. 3, this unit is not retained by riveting, but by a secure fit of the securing pins 25' located in the through holes 21 of the dial support 14.

It is, however, also possible in the embodiment of FIG. 3 to dispense with the pre-assembly of the dial unit and to position the dial support 14 coated with the adhesive layer 15 as a sub-unit together with the dial 16 directly onto the annular tool holder 13. The retaining ring 17' with its securing pins 25' welded thereto is then pushed thereover, it being necessary to form the short circuit-preventing hollow-cylindrically-shaped free spaces 31, the dial bolts 42 located in the bores 40 of the movement 13 being directed in such a way that the cutting surfaces 48 come to rest immediately adjacent the securing pins 25'. The retaining ring 17' is then anchored by turning the dial bolt 42 by about half a revolution.

A suitable tool, which is not shown herein, can optionally remove the now compact dial unit as a whole from the annular tool holder 13, for example in order to insert a dial 16 of a different design. The dismantled dial unit can be used for a different movement.

As already mentioned, the retaining ring 17' and the securing pins 25' welded thereto shown in FIG. 3 are of brass. It is, however, also possible to inject the entire assembly out of a single piece of plastics material. Apart from a low manufacturing price, this solution also has the advantage that the securing pins 25' cannot create any short circuit between the electrodes of the dial 16, making it possible to dispense with hollow cylindrically shaped free spaces 31 and eliminating the need for the adhesive layer 15 to have electrical insulating properties.

Again assuming that the retaining ring 17' and the securing pins 25' a swell as the dial support 14 shown in FIG. 3 are made of one metal, for example, brass, it is possible to effect the contact of the electrodes of the dial 16 as follows:

The upper electrode can be contacted directly through the retaining ring 17', whereby at least one securing pin 25' and the associated blind hole 22 shaped for example as a female contact bush ensures the electrical connection between the retaining ring 17' and the supply circuit (not shown) in the annular tool holder 13.

In contrast, the lower electrode of the dial 16 can be contacted directly through the dial support 14, the adhesive layer 15 being electrically conducting in this case. A contact spring projecting out of the annular tool holder 13, a zebra contact or also only one strip conductor now only touches the underside of the dial support 14 and no longer presses onto the dial 16 itself.

It should, however, be noted in this context that a short circuit would occur between the securing pins 25' and the dial support 14 according to FIG. 3. To prevent this, the hole 21 in the dial support 14 can be made larger to create a free space interposed therebetween. Since it is necessary to dispense with the press seating between the securing pins 25' and the dial support 14, which retains the dial unit, this solution is more suitable for assembling the dial support 14, the dial 16 and then the retaining ring 17' directly onto the annular tool holder 13.

This advantageous embodiment of the invention creates a new situation inasmuch as spring pressure is no longer exerted on the dial 16 to cause it to become detached, but an elegant method of contacting the electrodes is achieved by the shape of the retaining ring 17' of the invention.

It is, of course, also possible to provide rotatable dial bolts 42 according to FIG. 3 for the embodiments shown in FIGS. 1 and 2, it then being possible to dispense with a press seating of the securing pins 25.

FIGS. 4 to 6 show three other embodiments of the above-described retaining rings 17 and 17'. The dial support 14 with its through holes 21 and the dial 16 with its through holes 20 remain unchanged in this case. All that is differently shaped are the annular tool holder previously designated 13 and the retaining ring previously designated 17 and 17' with its securing pins 25 and 25'.

FIG. 4 shows a retaining ring 50 which has several preferably three curved brackets one of which is shown here and designated 51. These brackets 51 also termed legs are shaped from one piece together with the retaining ring 50, preferably punched out of brass sheeting. A first, straight leg area 52 of the bracket 51 shown runs approximately along the axis 18 through the through holes 20 and 21 and thus substantially orthogonal to the level of the retaining ring 50. Following on from this first leg area 52 is a second leg area 53 curved outwards in relation to the axis of rotation 12 not shown herein, which is located in a first hole area 54 of the annular tool holder, here designated 55. Following on from the outwardly curved leg area 53 there is an inwardly curved leg area 56 which extends into a second hole area 57 which is shaped larger in diameter and length than the hole area 54 and is formed as a blind hole.

When inserting the retaining ring 50 onto the annular tool holder 55, the brackets 51 deflect backwards in the direction of the axis 18 in order to pass through the holes 20, 21 and 54. In the final position, in which the retaining ring 50 rests against the dial 16, the leg areas 56 extend in each case from the axis 18 beyond the hole area 54, resting against one of the circular edges 58 formed by the two hole areas 54 and 57, about at the point at which the outwardly curved leg area 53 passes into the inwardly curved leg area 56. In this location, the brackets 51 are under spring tension and press outwards substantially in relation to the axis of rotation 12 with a radial and an axial component in the direction of the arrow 59, the retaining ring 50 being anchored on the annular tool holder 55. Instead of cylindrical hole areas 54 and 57 it is possible to provide square hole areas, which are not shown here, so as not to generate a point support as hereinabove described, but a line support which has various advantages, inter alia being less sensitive.

FIG. 5 shows a retaining ring 60 which also has several advantageously three angled brackets on which one is again shown and designated 61. Here, too, these brackets 61 and the retaining ring 60 are formed of one piece, preferably punched out of brass sheeting. The difference between the bracket 61 and that of FIG. 4 is only that they are divided into two in the direction of the axis 18, forming a first leg 62 and a second leg 63, these passing from one into the other at a fictitious rotation of 180° about the axis 18. In common with the bracket 51, the first leg 62 has an outwardly curved leg area 64 and an inwardly curved leg area 65 and the second leg 63 has an inwardly curved leg area 66 and an outwardly curved leg area 67.

When the retaining ring 60 is inserted onto the annular tool holder 55, the brackets 61 and/or the legs 62 and 63 give way in the direction of the axis 18 and pass through the holes 20, 21 and 54. In the final position in which the retaining ring 60 rests against the dial 16, the legs 62 and 63 in each case extend from the axis 18 over the hole area 54, resting against the circular edge 58 by analogy with the embodiment shown in FIG. 4. In this position, the legs 62 and 63 are under spring tension and press outwards or inwards substantially in relation to the axis of rotation 12 with in each case a radial and an axial component, i.e. the leg 62 in the direction of the arrow 68 and the leg 63 in the direction of the arrow 69, anchoring the retention ring 60 onto the annular tool holder 55. Instead of cylindrical hole areas 54 and 57, it is here also possible to provide square hole areas, which are, however, not shown, in order to generate a line support which has various advantages, inter alia being less sensitive.

FIG. 6 shows a retaining ring 70 which also has several advantageously three angled brackets, one of which is shown and designated 71. These brackets 71 are formed integrally with the retaining ring 70, advantageously also from brass sheeting. In common with the bracket of FIG. 5, the bracket 70 is also divided into two, i.e. it has a first leg 72 and a second leg 73 peripherally located in relation to the axis of rotation 12 shown in FIG. 1, which are congruent reflected to the axis 18. In contrast to FIGS. 4 and 5, both legs 72 and 73 are not shaped in radial direction in relation to the axis of rotation 12. In contrast, the two according to FIG. 6, which correspond to a peripheral sectional representation indicated in FIG. 1, each have a leg edge 74 and 75 respectively outwardly bent in relation to the axis 18 and an inwardly bent leg edge 76 and 77 respectively in each case adjacent thereto. At the level of the dial unit an embossing 78 driven into the bracket is shown which results in the spreading of the two legs 72 and 73.

When the retaining ring 70 is inserted onto the annular tool holder 55, the legs 72 and 73 give way in the direction of the axis 18 and pass through the holes 20, 21 and 54. In the final position in which the retaining ring 70 rests against the dial 16, the legs 72 and 73 in each case extend from the axis 18 over the hole area 54, resting against the circular edge 58 by analogy with the embodiment shown in FIGS. 4 and 5. In this position, the legs 72 and 73 are again under spring tension and exert pressure substantially only tangentially in each case in the direction of the arrow 79 and 80 respectively onto the annular tool holder 55. Here again, this anchors the retaining ring 70 to the annular tool holder 55.

As a basic rule, the retaining rings 50, 60 and 70 are only inserted when dial supports 14 and dial 16 are already positioned as a unit onto the annular tool holder 55.

The retaining rings 50, 60 and 70 shown in FIGS. 4, 5 and 6 can, as already stated hereinabove in the case of FIG. 3, serve as contact element for the upper electrode of the dial 16. By analogy, contact bushes can again be provided in the annular tool holder 55.

In all embodiments the contact springs can be replaced by so-called zebra contacts which have a conducting foam-like area pressing against the electrodes of the dial 16.

In addition to its original function as a mechanical connection means, the retaining ring can also serve as an information support. In this case, the retaining ring can for example have lines, numbers, time zones or any other information on its upper side 34. Indices of this nature have, however, been excluded from the figures.

The retaining ring can also serve as a design feature. For example, a colour or pattern that differs from the dial 16 creates a decorative effect. In this case it may be appropriate not to manufacture the retaining ring 17', 50, 60 and 70 shown in FIG. 3 of plastics material, but also that designated 17 in FIGS. 1 and 2, the rivet-shaped securing pins 25 still advantageously being of metal. If the retaining ring should not be visible to the wearer of the timepiece, the housing of the timepiece must be shaped accordingly, or the ratio of size between timepiece housing and dial 16 should be such that the retaining ring remains hidden.

It may basically be appropriate to provide the retaining ring of the invention also for non-electroluminescent dials. This may, for example, be the case for dials which consist of photographic portraits. In such cases, the retaining ring prevents the photograph from buckling as a result of humidity.

The device of the invention makes it possible to ensure a smooth, even and permanent support of the dial on the dial support without the dial detaching from the dial support or buckling with time because of the contact spring pressure. The device of the invention also permits a simpler, optionally frequent assembly and dismantling of the unit composed of the dial, dial support and retaining ring onto or from a base unit, such as a base plate or an annular tool holder. This makes it possible to store prefabricated dial units of the most varied design whole for assembly as required.

What is claimed is:

1. A timepiece having:

a base element, a dial support, an electroluminescent dial having an outer peripheral area, an annular element, and securing means;

wherein:

the dial support is supported on the base element;

the electroluminescent dial is supported on the dial support;

the annular element is disposed on the electroluminescent dial and covers, at least partially, the outer peripheral area of the electroluminescent dial; and the securing means secures the annular element to the base element and thereby also secures the electroluminescent dial and the dial support disposed between the annular element and the base element to the base element.

2. A timepiece according to claim 1, wherein the securing means is firmly attached to the annular element and includes at least one projecting part which extends into a recess of the base element.

3. A timepiece according to claim 2, wherein the projecting part substantially has the form of a cylindrical shaft and the recess is shaped as hole for receiving the cylindrical shaft.

4. A timepiece as in claim 2, wherein there are a plurality of projecting parts and each projecting part is formed as only one bracket, each bracket being disposed in only one recess of the base element and having a radially outwardly (relative to the annular element) curved leg area and a radially inwardly (relative to the annular element) curved leg area; with each bracket exerting pressure in an outward direction against the base element.

5. A timepiece as in claim 2, wherein the at least one projecting part is formed by a pair of brackets, the pair of brackets being disposed in only one recess and comprising:

a first bracket having a substantially radially (relative to the annular element) outwardly-curved leg area followed by a substantially radially (relative to the annular element) inwardly curved leg area and exerting a pressure in a first substantially radial direction; and a second bracket having a substantially-radially (relative to the annular element) inwardly-curved leg area followed a substantially-radially (relative to the annular element) outwardly-curved area and exerting a pressure in a second substantially radial direction opposite to the first direction.

6. A timepiece as in claim 2, wherein the at least one projecting part is formed by a pair of brackets, the pair being disposed in only one recess and comprising:

a first bracket exerting pressure in a first substantially tangential direction (relative to the annular element); and, a second bracket exerting pressure in a second substantially tangential direction (relative to the annular element), opposite to the first substantially tangential direction.

7. A timepiece as in claim 1, wherein the annular element is a closed ring covering the outer peripheral area of the electroluminescent dial.

8. A timepiece as in claim 7, wherein the securing means is firmly attached to the annular element and includes at least one projecting part which extends into a recess of the base element.

9. A timepiece as in claim 1, wherein a layer is positioned between the dial support and the electroluminescent dial.

10. A timepiece as in claim 9, wherein the securing means is firmly attached to the annular element and includes at least one projecting part which extends into a recess of the base element.

11. A timepiece as in claim 1, wherein the annular element is a closed ring covering the outer peripheral area of the electroluminescent dial and there is a layer between the dial support and the electroluminscent dial.

12. A timepiece as in claim 11, wherein the securing means is firmly attached to the annular element and includes at least one projecting part which extends into a recess of the base element.

13. A method for manufacturing the timepiece of claim 3, comprising the step of manufacturing the annular element and a plurality of projecting parts by injection molding the annular element and the projecting parts as a single piece.

14. A method for manufacturing the timepiece of claim 3, comprising the step of welding a plurality of projecting parts to the annular element.

15. A method for manufacturing the timepiece of claim 3, including the step of pressing a plurality of cylindrical shafts into a plurality of holes in the base element.

16. A method for manufacturing the timepiece of claim 3, comprising the step of attaching the cylindrical shaft in the hole by placing an adjacent dial bolt having a disc-shaped cutting edge in the base element adjacent the cylindrical shaft and causing the disc-shaped cutting edge of the dial bolt to engage with the cylindrical shaft.

17. A method for manufacturing the timepiece of claim 2, including the steps of manufacturing projecting parts as one piece with the annular element so that the projecting parts take the form of brackets, and then extending these brackets into recesses of the base element.

18. A method as in claim 17, wherein the step of manufacturing the projecting part and annular element as one piece includes the substep of punching them from one piece of material.

19. A timepiece according to claim 3, wherein the projecting part is formed as a pin which is a separate member from the annular element having a flange/flange rivet-shaped portion which encloses at least the annular element and the dial.

* * * * *